United States Patent [19]

Fischer

[11] Patent Number: 4,510,868

[45] Date of Patent: Apr. 16, 1985

[54] CIRCUMFERENTIALLY CONTINUOUS CYLINDER FOR A ROTARY PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 630,078

[22] Filed: Jul. 12, 1984

[30] Foreign Application Priority Data

Jul. 21, 1983 [DE] Fed. Rep. of Germany ..... 3326215

[51] Int. Cl.[3] ..... B41F 7/22; B41F 27/12

[52] U.S. Cl. ..... 101/415.1; 101/382 MV; 101/375

[58] Field of Search ..... 101/415.1, 378, 375, 101/382 MV

[56] References Cited

U.S. PATENT DOCUMENTS

| | | | |
|---|---|---|---|
| 1,545,791 | 7/1925 | Owen | 101/415.1 |
| 2,056,991 | 10/1936 | Tomlin | 101/415.1 |
| 2,105,452 | 1/1938 | Busk | 101/415.1 |
| 2,375,603 | 5/1945 | Willard | 101/415.1 |
| 2,539,969 | 1/1951 | Peevey | 101/415.1 X |
| 3,217,645 | 11/1965 | Martt | 101/415.1 |

FOREIGN PATENT DOCUMENTS

| | | | |
|---|---|---|---|
| 60939 | 9/1982 | European Pat. Off. | 101/415.1 |
| 2804304 | 12/1980 | Fed. Rep. of Germany . | |
| 1367860 | 6/1964 | France | 101/415.1 |
| 2094716 | 9/1982 | United Kingdom | 101/415.1 |

*Primary Examiner*—Clifford D. Crowder
*Attorney, Agent, or Firm*—Frishauf, Holtz, Goodman & Woodward

[57] ABSTRACT

To support a cover wrapped about the printing cylinder and prevent oscillations and resonance phenomena from arising when an attachment groove (2, 23) passes along an adjacent cylinder, a filler strip (8) is located within the groove to close off the groove. The filler strip has circumferentially extending fingers (14) which are supported on circumferentially extending fingers (15) projecting circumferentially from within the groove. The filler strip is axially shiftable along the fingers so that the gap between the support fingers (15) can be used to drop the comb fingers (14) on the filler strip radially inwardly, thus retracting the filler strip. The filler strip is preferably retracted by a retracting mechanism such as a slotted guide tube (11) engaging a lifting strip (10) projecting circumferentially from the filler strip. Axial shifting of the filler strip to place the comb fingers of the filler strip above the support fingers (15) projecting from the groove, after raising of the filler strip, to be flush with the cirmcumference of the cylinder is effected by an eccentered positioning drive located, for example, at an end face of the cylinder. The arrangement permits use of rubber blankets which have end portions fitting in a tiny gap between the filler strip and the groove, with the rubber blankets having ends fitting precisely against each other, thus providing an essentially continuous surface to an engaging cylinder.

15 Claims, 12 Drawing Figures

CIRCUMFERENTIALLY CONTINUOUS CYLINDER FOR A ROTARY PRINTING MACHINE

The present invention relates to a cylinder for a rotary printing machine, and more particularly to a cylinder which includes a groove to accept the end portions of a cylinder cover, such as a rubber blanket if the cylinder is to be used in an offset printing machine, or a printing plate, either for offset printing or other types of printing, such as a printing plate which has a profiled surface, and which includes an arrangement to prevent the groove from interrupting the surface of the printing cylinder, when equipped with a cover layer, to thereby reduce shocks arising upon rotation of the cylinder in contact with another cylinder within the printing apparatus.

BACKGROUND

It has previously been proposed to provide a filler strip to close off the outer portion of grooves in which, for example, rubber blankets can be secured and stretched, see, for example, German Published Patent Application DE-AS 28 04 304. This patent discloses a combination stretching, holding, and filling arrangement for the forme cylinder of a gravure printing press. The filler uses two filler strips which can be clamped in the groove of the cylinder by clamping arrangements. Each one of the filler strips is connected with an end of the printing plate. The combination clamping-and-filler strip arrangement is complex and, hence, results in an expensive overall construction.

Discontinuities in the circumference of printing machine cylinders are highly undesirable, since they cause shocks and vibrations to occur. Bearer rings, mounted for example at the ends of the shafts of the cylinders, become worn, and deformed in the regions where the discontinuities arise, due to shocks which are transmitted to the bearer rings. The noise level of the machine, in operation, is enhanced.

THE INVENTION

It is an object to provide a cylinder for a rotary printing machine which is formed with an axial groove in which the cylinder has a strip located therein which renders the circumference of the cylinder essentially continuous, which is simple to construct, capable of accepting substantial engagement forces for the covering for the cylinder as well as forces transferred from an adjacent cylinder with which it may be in contact.

Briefly, a plurality of comb fingers extend, comb-like, from the filler strip in a generally circumferential direction, located within the groove. The groove walls are formed with a plurality of matching support fingers which project from the inside of the groove in the cylinder, so that, upon proper alignment of the filler strip, the filler strip comb fingers can be placed above the support fingers in the groove so that the filler strip will be supported throughout its length. Upon axially shifting the filler strip, the comb fingers of the filler strip can drop between the support fingers, and the filler strip can be readily removed from the groove by sliding it out axially. In accordance with a feature of the invention, an axial positioning arrangement is provided, engageable with the filler strip for axially moving the filler strip between an insertion or removal position in which the comb fingers are clear of the support fingers, and a supported position of the comb fingers, in which they are supported by the support fingers on the cylinder. In accordance with another feature of the invention, a two-part interengaging, externally operable lifting element is provided, engageable with the filler strip to lift the filler strip into a position in which, upon axial sliding, it can be placed in the supported position. The interengaging lifting means, for example, can be a longitudinally slit cylinder which engages the fingers, or a portion of the support strip, to raise the support strip from a dropped position, within the outline of the circumference, to a raised position in which the outer circumference of the filler strip essentially completes the circumference of the cylinder and closes the groove, leaving only enough of a gap to permit passage of the ends of the cover, for example a cover blanket, or a cover plate, to penetrate into the groove.

The arrangement has the advantage that the filler strip is a single element which can be easily raised and lowered by simple radial shifting; and that, after raising, simple axial shifting places the filler strip in a position to close off the groove so that the groove shocks which arise upon passage of the grooves past another cylinder are effectively prevented. Such groove shocks may, at certain speeds, result in inherent vibrations of the cylinder. These vibrations or oscillations which, under resonant conditions, can become substantial, are thereby effectively avoided.

The arrangement has the further advantage that it is readily removable so that the filler strip will not impede threading of blankets, plates, or other covers on the cylinder.

DRAWINGS

DETAILED DESCRIPTION

Figure 1:
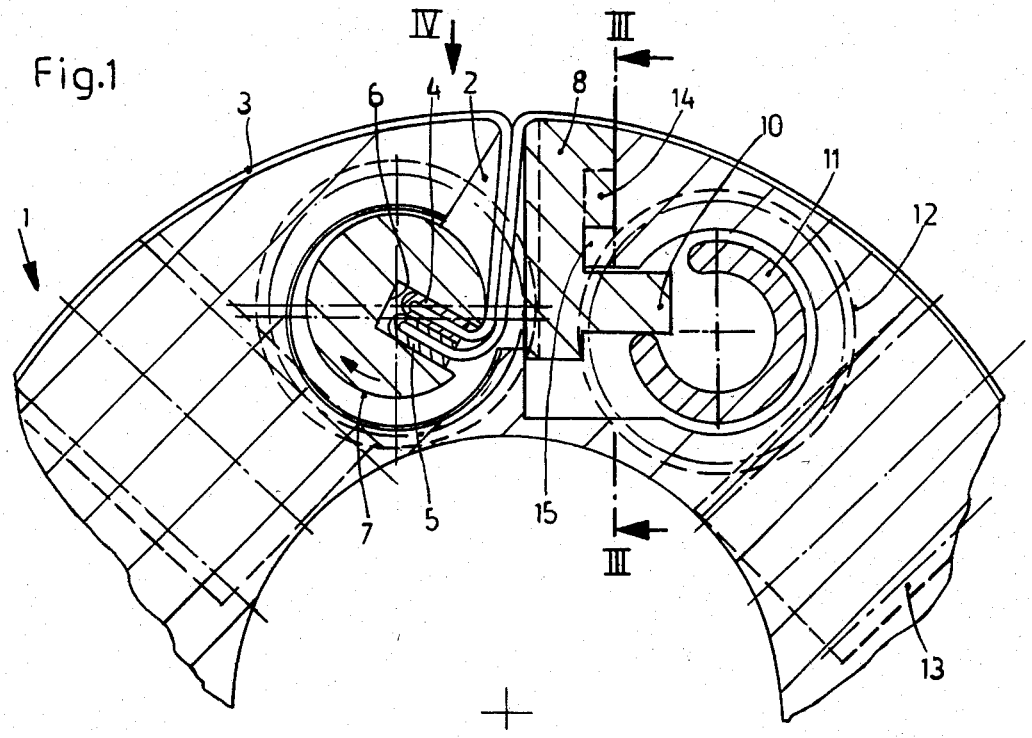
FIG. 1 is an axial fragmentary cross-sectional view through a cylinder illustrating a rubber blanket clamped in a groove, with a filler strip in raised position.

FIGS. 1–4 illustrate an embodiment of the invention particularly suitable for use with rubber blankets in an offset printing machine. A blanket cylinder 1 of an offset printing machine is formed with an axial groove 2 to receive the ends of a rubber blanket 3. The rubber blanket 3 has reinforced end portions 4, 5, forming reinforcing strips to facilitate insertion of the rubber blanket. The reinforced end strips 4, 5 can be fitted into a slot 6 of a clamping spindle 7.

Figure 2:
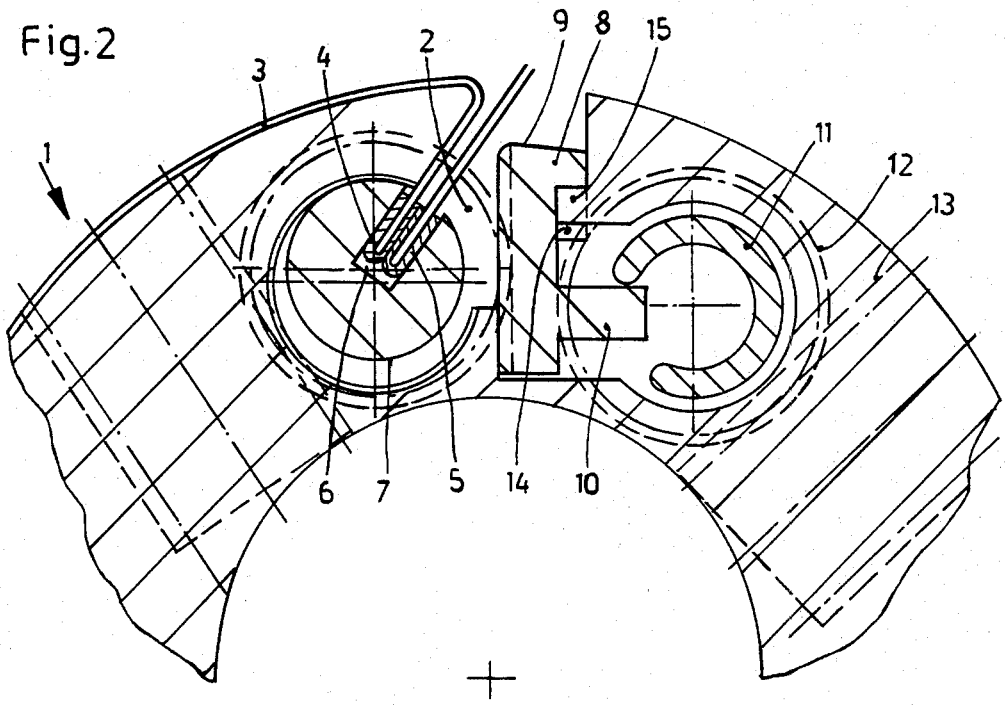
FIG. 2 is a view similar to FIG. 1, with the filler strip dropped.

FIG. 1 illustrates the rubber blanket 3 in tightened condition, stretched about the circumference of the cylinder 1. As clearly seen in FIG. 1, the groove 2 is completely covered and closed by a filler strip 8. FIG. 2 illustrates the filler strip 8 in retracted or dropped position, which easily permits introduction of the rubber blanket, and particularly of the reinforcing end strips 4, 5 thereof in the slot 6.

In operation of threading of the rubber blanket, the rubber blanket is placed about the cylinder and the end strips are then, together with the blanket, moved axially around the cylinder, fitting within the slot 6 of the clamping spindle 7. The clamping spindle 7 is then rotated to the position shown in FIG. 1 to clamp the rubber blanket. It need not be rotated completely to the position shown in FIG. 1, but can lead the blanket in slightly unstretched position, that is, to a position intermediate the position of FIGS. 1 and 2.

Thereafter, the filler strip 8 is lifted from the dropped or depressed position of FIG. 2 to the raised or operating position of FIG. 1 so that the circular contour of the blanket cylinder will be retained. The surface 9 of the filler strip 8 will closely match the contour of the circumference of the cylinder 1 and, thus, provide for an essentially continuous surface of the blanket cylinder, in which the edges of the filler strip 8 merge smoothly towards the edges of the blanket cylinder 1 adjacent the groove. The only gap which will be left will be the one through which the end portions of the blanket 3 can pass; that remaining slit will have roughly twice the thickness of the blanket 3.

Figure 3:
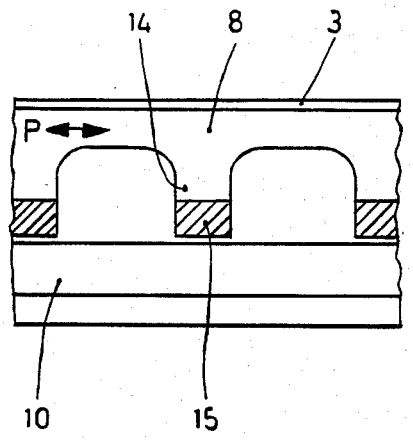
FIG. 3 is a cross section through the groove along line III—III of FIG. 1.
Figure 4:
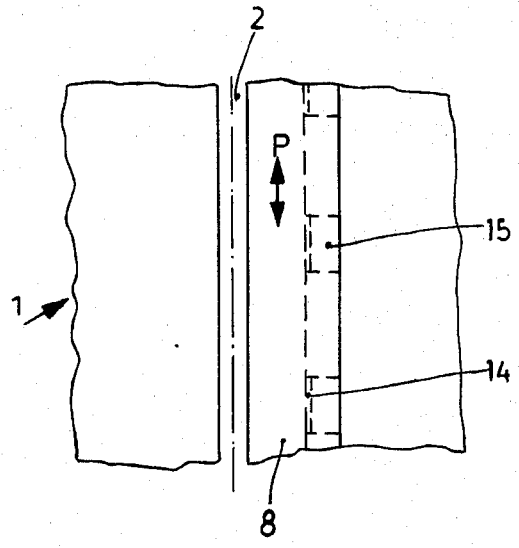
FIg. 4 is a top view of the closed groove, along the arrow IV of FIG. 1.
Figure 5:
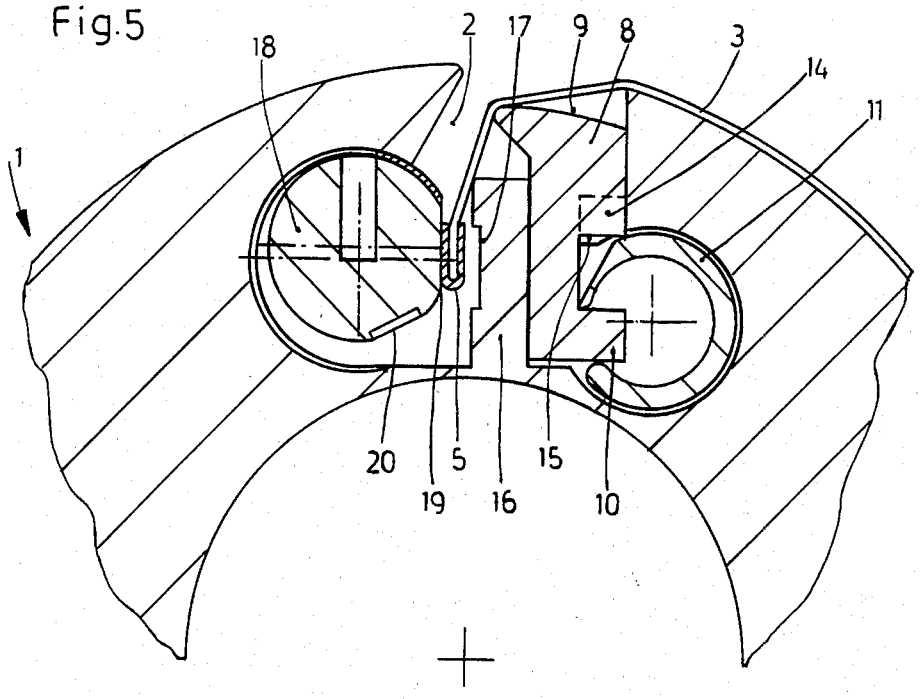
FIGS. 5 through 8 show another embodiment of a filler strip to attach a rubber blanket to a printing cylinder in sequential positions with respect to insertion of the filler strip and the rubber blanket, and removal thereof.

A suitable construction for the filler strip 8 is shown in FIGS. 3 and 4, when taken together with FIGS. 1 and 2. The filler strip 8, as best seen in FIG. 3, is formed with comb-like projecting fingers 14, spaced from each other. When the filler strip 8 is in the position shown in FIG. 1, it is shifted axially so that the fingers 14 thereof will come to lie above support fingers 15 which project from the inside wall of the cylinder within the groove. This is a supported position of the strip 14, in which the fingers 14 are securely supported by the fingers 15. The filler strip can be moved axially, as shown schematically by the double arrow P, to an insertion or removal position in which the fingers 14 do not align with the fingers 15. In that position, the filler strip 8 may be placed within the groove to a dropped or retracted position, as shown in FIG. 2. In the retracted position, the filler strip can be axially removed, or left in place, and the rubber blanket 3 can be easily inserted, as described above.

The fingers 15, preferably, are directly formed on the walls of the cylinder 1.

Raising the filler strip 8 from the dropped or retracted position to the raised position shown in FIG. 1 is preferably carried out by engagement with a raising strip 10, extending in circumferential direction (see FIGS. 1 and 2) from the filler strip 8. The raising strip 10 is not strictly necessary, and other elements, even the fingers themselves, may be engaged. The raising strip 10 is located within an axially extending slot of a rotatable raising guide tube 11. Upon rotation of the guide tube 11, filler strip 8 will be raised and lowered or dropped between the insertion-removal, and then supported position (FIG. 1) and the retracted or dropped position (FIG. 2).

Figure 12:
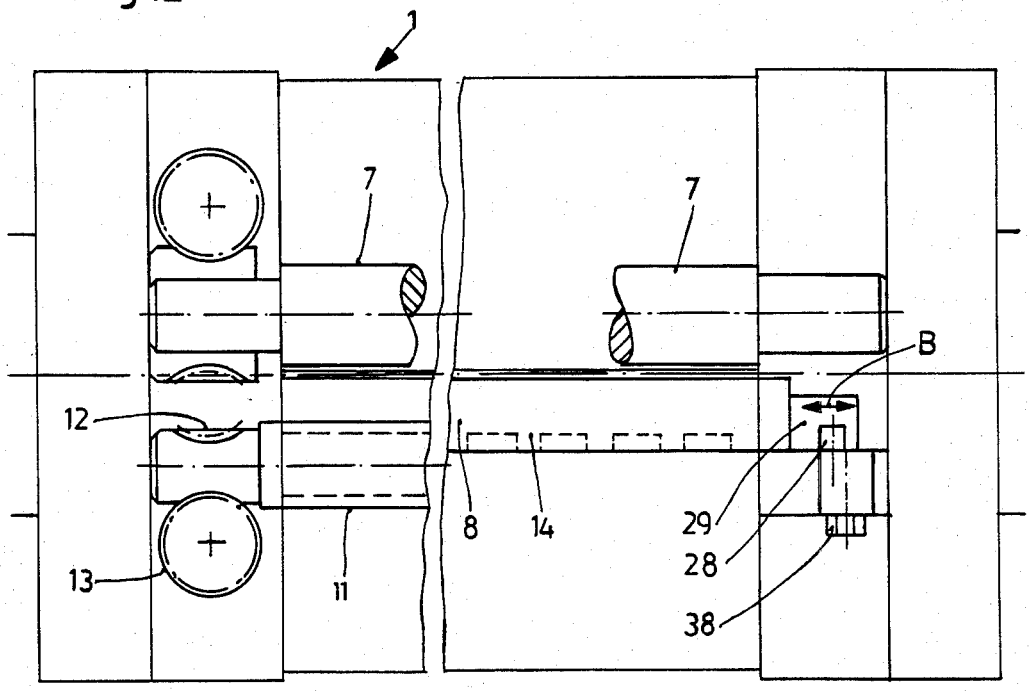
FIG. 12 is a schematic illustration showing apparatus for axially shifting the filler strip.

The guide tube 11 can be rotated in any suitable manner. FIG. 12 illustrates an arrangement in which the guide tube 11 is rotated by a worm drive, including a worm wheel 12 and a worm 13, both located at a facing end portion of the blanket cylinder 1. The guide tube 11 extends beyond the facing end surface so that the end face of the wheel 12 can be fitted thereon in any suitable manner. The guide tube 11 can be supported within the blanket cylinder 1 in any suitable manner, for example within a circular opening cut therein, as shown in FIGS. 1 and 2.

Insertion of a rubber blanket: First, the clamping cylinder 7 is brought into the position shown in FIG. 2, and the filler strip 8 is placed in dropped or retracted position as shown in FIG. 2 by suitable rotation of the guide tube 11. After introducing the reinforcement strips 4 and 5 into the slot 6 of the clamping spindle 7, the clamping spindle 7 is partially rotated. The filler strip 8 is then lifted into the position shown in FIG. 1 by rotation of the guide tube 11. Thereafter, the filler strip 8 is axially shifted, for example by an eccenter drive also shown in FIG. 12, to place the comb fingers 14 above the support fingers 15 projecting from the cylinder 1 into the groove. The clamping cylinder 7 is then tightened to effect final clamping and stretching of the rubber blanket 3 about the now essentially continuous circumference of the cylinder 1.

The eccentric drive shown in FIG. 12 includes an eccentric 29 and an axial pin 28 secured to the filler strip 8. The eccentric drive can be located on one of the end faces of the blanket cylinder 1. Fingers 14 of the filler strip thus can be moved, by axial shifting of the filler strip 8, above the support fingers 15 within the groove of the cylinder.

In operation, the filler strip 8 is thus supported from the cylinder itself, so that no load is placed on the slotted guide and lifting cylinder 11. Further, the filler strip will not bend through or otherwise deform since the comb fingers 14 can be closely spaced and located all along the length of the filler strip, supported by the support fingers 15 repeatedly along the length. Uniform support is thus inserted. The filler strip, additionally, is guided along the wall surface of the groove, and, additionally, can be guided and supported at its back surface from an element rotatable for example with the clamping cylinder 7—as will appear. The filler strip 8, thus, cannot twist or shift or move in slanted position. The axial shift of the filler strip 8 is schematically indicated by the arrow P in FIGS. 3 and 4.

It is not necessary that both ends of the covering, for example the rubber blanket, to be applied over the cylinder 1 be retained within the clamping spindle 7. Referring to FIGS. 5 to 8: The covering blanket 3 has only one reinforcement strip 4 located within a clamping spindle 18. The reinforcement strip 5 of the other end of the blanket 3 is secured in the groove itself. In the position shown in FIG. 5, it is easily possible to introduce one end portion with the reinforcement strip 5 of the blanket into the groove. To insure attachment of the end strip 5, a holding rail 15 is formed within the region of the bottom of the groove, which has an axially extending recess or groove 17 formed therein into which the strip 5 can fit. The clamping spindle 18 is formed with essentially circular circumference except for two flattened zones. The flattened zone 19 is preferably located opposite the groove 17 for first insertion of the end strip 5. Upon only slight rotation of the clamping spindle 18, the circular surface of the clamping spindle will engage against the end strip 5 of the blanket and push the end strip 5 of the blanket into the receiving groove 17 of the holding rail 16—see FIG. 6. FIGS. 5 to 8 are drawn with somewhat exaggerated clearances for ease of illustration.

Figure 6:
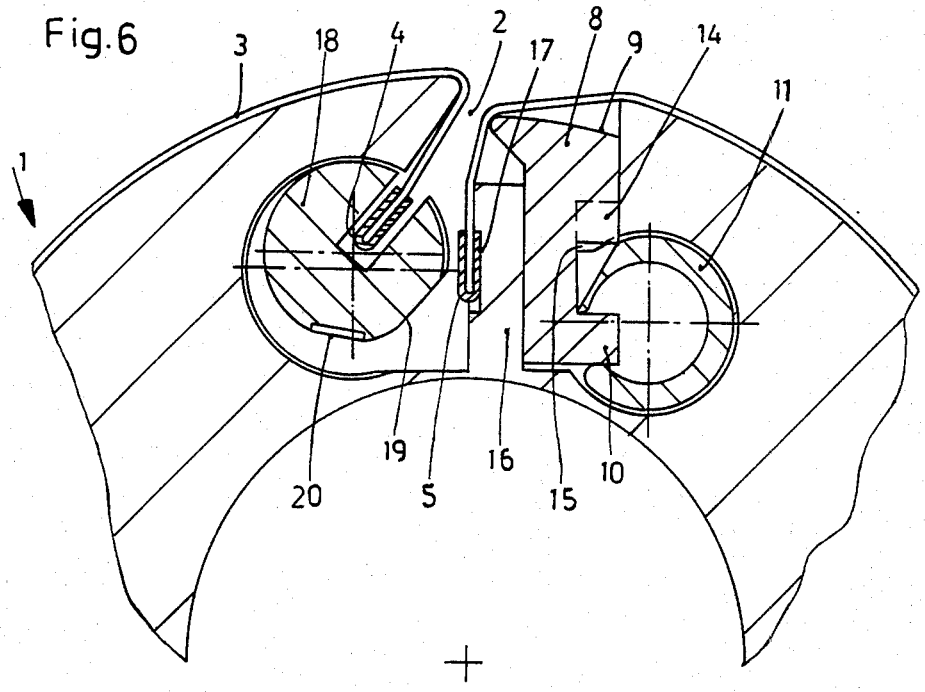
Figure 7:
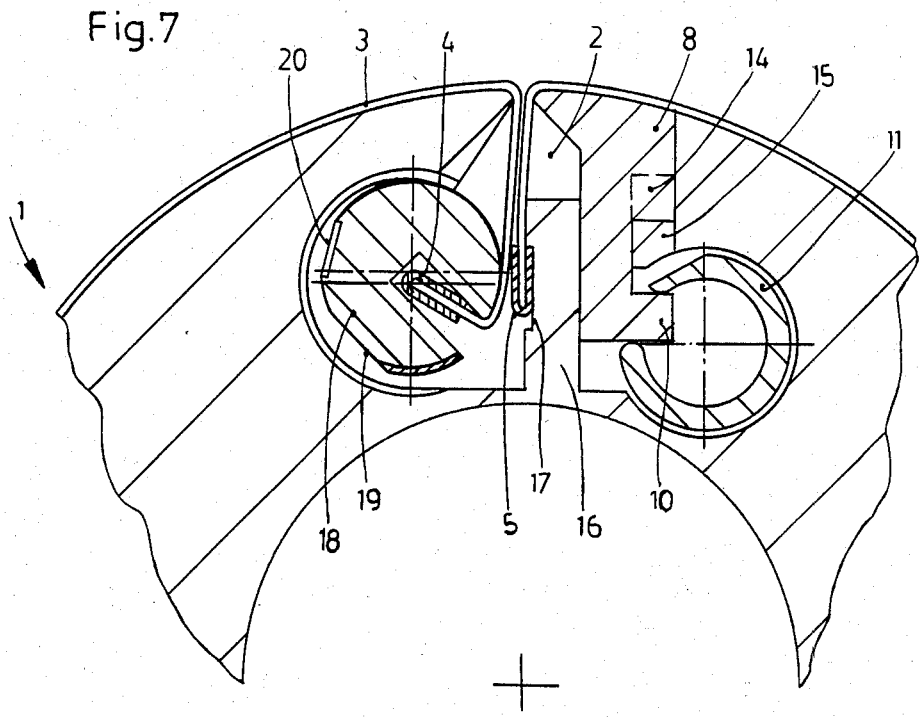

The blanket 3 can then be wrapped around the cylinder and the end strip 4 inserted in the groove of the clamping spindle 18—see FIG. 6. Upon further rotation of the clamping spindle 18, the blanket 3 is preliminarily tightened about the circumference of the cylinder 1. Thereafter, the guide tube 11 is rotated to move the cover strip 8 from the retracted or depressed or dropped position shown in FIGS. 5 and 6 to the raised position shown in FIG. 7, and the strip 8 is then axially shifted to engage the comb fingers 14 thereof above the support fingers 15 formed in the cylinder 1. The clamping spindle 18 can then be rotated for final clamping and stretching of the blanket 3, as well known and as standard in offset blanket printing machinery technology.

Figure 8:
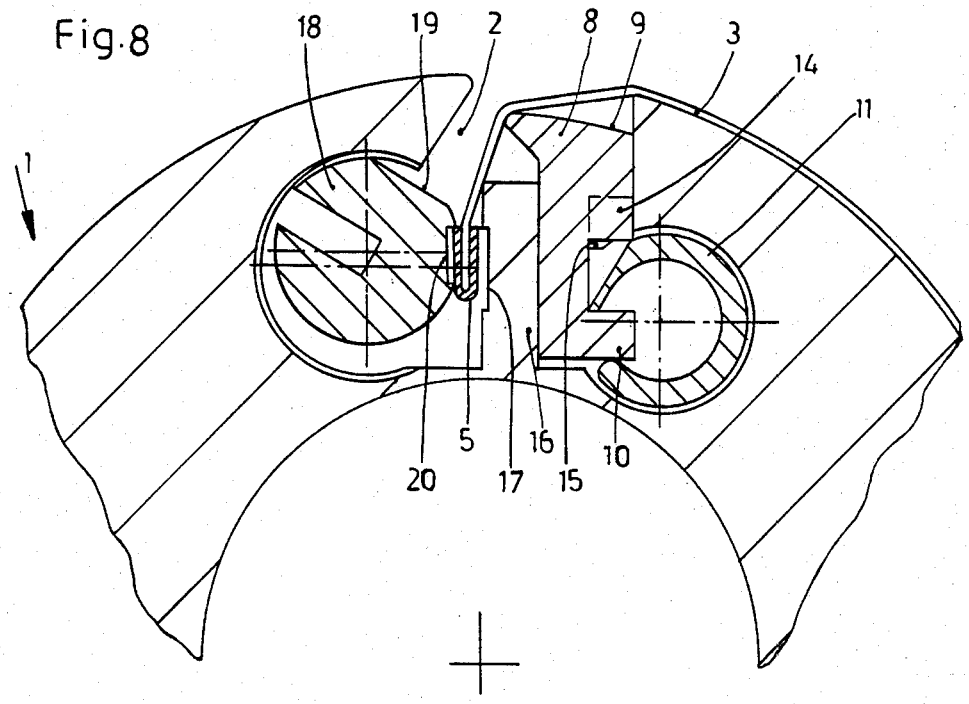

FIG. 8 illustrates another suitable feature of the construction in accordance with the present invention. When the clamping spindle 18 is rotated in the position shown in FIG. 8, a magnetic strip or magnetic system 20 thereon will come to lie opposite a ferromagnetic strip or element or group of elements located within the reinforcing strip 5 of the rubber blanket. The reinforcing strip 5 itself may be made of magnetizable material, such as steel. In the position shown in FIG. 8, the steel portion or the entire strip 5 will be attracted by the magnet 20, and removed from the axial groove 17. By slight rotation of the clamping spindle 18 in counterclockwise direction—with respect to FIG. 8—it is easily possible to pull off the end portion retaining the strip 5 of the rubber blanket 3. Of course, the end portion with the strip 4 has previously been removed from the clamping spindle 18.

In this embodiment, the rubber blanket 3 is stretched only by deflection of one end of the blanket 3, namely the end having the reinforcing strip 4 which is clamped in the clamping spindle 18, whereas in the embodiment of FIG. 2, both ends with the strips 4, 5 are tightened in the groove.

Figure 9:
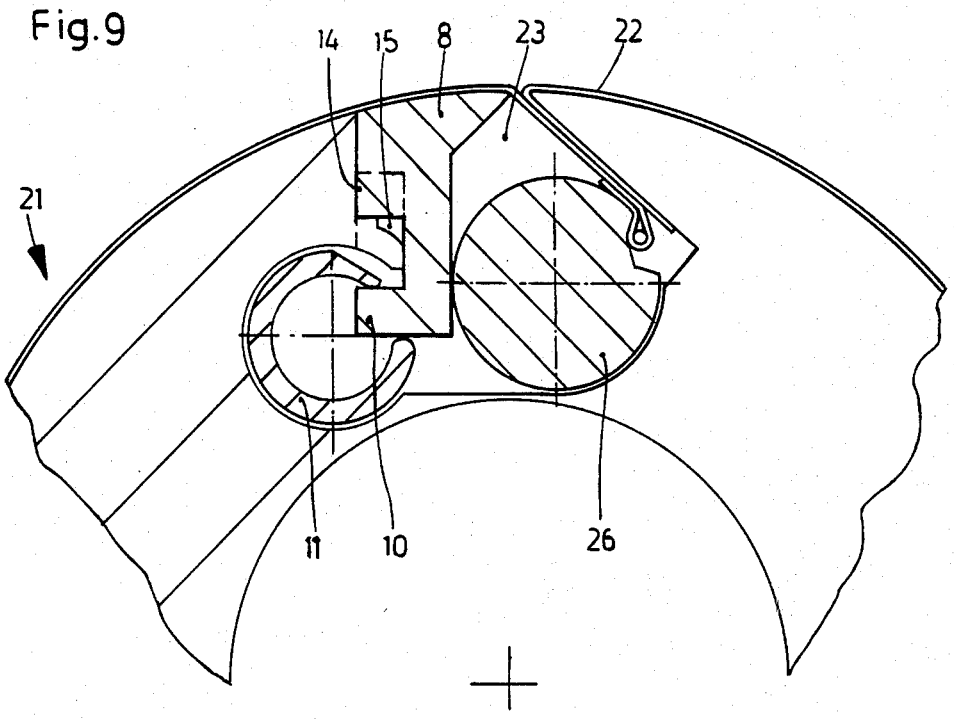
FIGS. 9 and 10 illustrate placement of a filler strip in a cylinder which has a printing plate applied thereto, in axial cross-sectional view.
Figure 10:
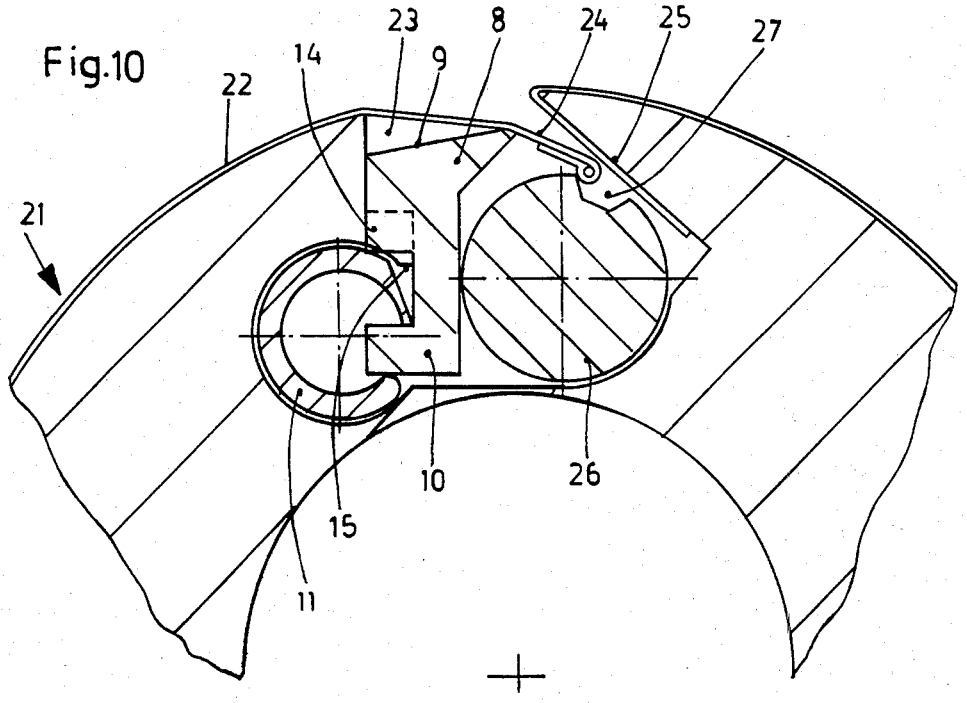

The present invention is suitable not only for rubber blankets on rubber blanket cylinders in rotary offset printing machines, but also for plate cylinders and for gravure cylinders in which, for example, a wrap-around plate is applied to a cylinder. Referring to FIGS. 9 and 10, in which the filler strip 8 is located at the left side—with respect to the orientation of the drawings—of the groove: The filler strip 8 is in its retracted position—as shown in FIG. 9, and in this position it is easily possible to insert the bent-back end 25 (FIG. 10) of a printing plate 22, or a wrap-around plate, as desired, on a forme cylinder 21, in which the forme cylinder has a groove 23. The other end 24 of the offset printing plate or the wrap-around or other type of plate 22 is then placed into a clamping groove 27 of a clamping spindle 26—as seen in FIG. 10. The filler strip 8 is then placed into raised position by rotation of the slotted guide tube 11 to the position shown in FIG. 9. In this position, the groove 23 is closed, that is, is covered. The clamping spindle 26, prior to complete raising of the strip 8, has been tightened preliminarily; it can be finally tightened after axial shifting of the clamping strip 8 so that the comb fingers 14 engage over the support fingers 15 after axial shifting of the strip 8. The filler strip 8 is guided at its back side, in FIG. 9 the right side, directly by the circumference of the clamping spindle 26, and axially all along the clamping spindle 26, so that it cannot escape from the slot of the guide and raising tube 11.

Figure 11:
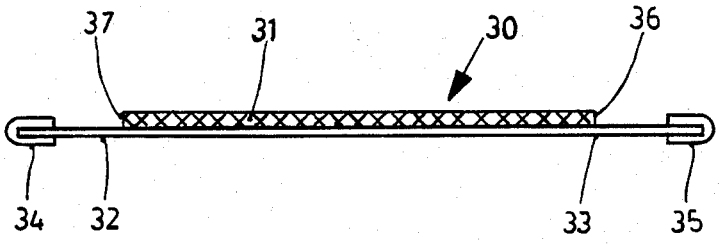
FIG. 11 is an illustration of a rubber blanket for use, for example, in the embodiment of FIGS. 1 to 8.

FIG. 11 shows a particularly advantageous construction of a rubber blanket for use with the embodiments of FIGS. 1–8: The rubber blanket 30 has a rubber blanket cover 31 which is applied to a substrate, for example a woven substrate, having projecting ends 32, 33 extending beyond the rubber blanket. The rubber blanket 31 can be applied, continuously, to the webs and, after cutting to a suitable length, merely removed at the end portions so that only the woven textile backing 32, 33 will remain. Reinforcing strips, for example metal U-strips 34, 35, are preferably connected to the end portions of the backing web 32, 33. The length of the blanket 31—considering the elongation due to stretching of the blanket 30—is so adjusted that, after placement of the blanket 30 on a cylinder, the edges 36, 37 at the end of the blanket will just fit against each other, to provide an almost seamless transition zone which will insure shock-free, smooth transition of an engaging roller from one end of the blanket to the other upon mutual rotation. An engaging roller, thus, in effect will "see" a continuous rubber blanket, without interruption.

Preferably, the rubber portion of the blanket and the overall blanket are dimensioned as aforesaid; an additional advantage of this dimension is that the end portions of the blanket 30, that is, the exposed substrate or backing webs 32, 33, can be inserted into grooves which are narrower than grooves which must also receive the rubber coating. This permits dimensioning the remaining gap between the filler strip 8 and the blanket cylinder so small that no shocks or jolts will result as the cylinder rolls against an engaging cylinder; these shocks or jolts, in structures with open grooves, lead to oscillations within the cylinder which, at certain critical speeds, may result in resonance phenomena which are undesirable, and may lead to striping of printed products.

A typical circumference of the cylinder is in the order of about 60 cm. The critical width of the groove is at about 2 mm. Blankets customarily used in offset printing technology have a thickness of about 1.9 mm, of which about half is due to the backing or textile web substrate and the rest is rubber blanket material. By suitable dimensioning of the filler strip 8, it is thus possible to form a groove through which only the web portions of the rubber blanket pass which is smaller than the critical dimension of 2 mm.

The engaging edges 36, 37 of the blanket 31 can be inclined with respect to the axial dimension thereof, so that the engaging seam will extend slightly spirally with respect to the cylinder, that is, slightly inclined above the groove 2 of the cylinder.

The filler strip 8 can be easily moved axially by an eccentric drive, as best seen in FIG. 12. The rubber blanket cylinder 1 shown in FIG. 12 has at the right side thereof an eccenter pin 28 which engages in the axial stub 29 of the filler strip 8 to provide for axial shifting in the direction of the double arrow B. A hex-nut 38, engageable, for example, by a socket wrench, is used to rotate the eccenter. FIG. 12 also shows the worm-and-gear drive 12, 13 to rotate the guide tube 11 and to provide for raising and lowering of the filler strip 8; FIG. 12 also shows the worm drive for rotation of the clamping spindle 8, although only schematically, since such arrangements are well known in printing machinery technology.

Various changes and modifications may be made, and any features described herein may be used with any of the others within the scope of the inventive concept.

I claim:

1. Circumferentially essentially continuous printing cylinder (1, 21) for a rotary printing machine having an axial groove (23) extending from the circumference thereof to permit insertion of end regions (5, 6, 24, 25, 34, 35) of a cover, such as a blanket (3, 30) or a plate (22), over the circumference of the cylinder, and an axially extending filler strip (8) for closing the groove at the circumference of the cylinder to provide an essentially closed circumference beneath the cover after insertion of the ends of the cover in the groove, comprising, in accordance with the invention, a plurality of comb-like fingers (14) extending from the filler strip in generally circumferential direction within the groove;

a plurality of matching support fingers (15) projecting from the cylinder and located within the groove, the comb fingers (14) and the support fingers (15) being dimensioned and positioned to locate the circumference of the strip essentially flush with the circumference of the cylinder when the comb fingers (14) are located in supported position above the support fingers (15), said comb fingers and support fingers being spaced from each other by a distance which is at least as great as the width of the respective fingers to permit, upon axial sliding of the filler strip, disengagement of the comb fingers from the support fingers and movement of the filler strip radially inwardly of the cylinder to a dropped or retracted position within the groove;

and two-part interengaging, externally operable lifting means (10, 11), one part, each, being located respectively on the filler strip and in the cylinder in the region of the groove to effect radial movement of the strip and hence of the fingers between the dropped position in which the strip is within the circumference of the cylinder, and a raised position in which the strip is essentially flush with the circumference of the cylinder, while permitting axial shifting of the strip to place the comb fingers in supported position on the support fingers within the groove.

2. Cylinder according to claim 1, further including axial positioning means (28, 29, 38) engageable with the filler strip for axially moving the filler strip between a supported position in which the comb fingers (14) are in engagement with and supported by the support fingers (15), and an insertion-and-removal position in which the comb fingers (14) are clear of the support fingers (15) and positioned in gaps or spaces between the support fingers to permit movement of the strip into the dropped or retracted position by said interengaging lifting means.

3. Cylinder according to claim 2, wherein the filler strip (8) has a portion extending beyond an end face of the cylinder;

and the axial positioning means comprises an eccenter drive (28, 29, 38) engageable with said end portion to provide for axial shifting of said filler strip (8).

4. Cylinder according to claim 3, wherein one one part of the interengaging lifting means (10, 11) comprises a guide tube (11) formed with an axially extending slot, and rotatably positioned within a part-circular opening in the groove;

the other part comprises an engagement strip (10) formed on the filler strip (8) and engaging within the slot of the guide tube;

and a geared drive coupled to an end portion of the guide tube, located adjacent an end face of the cylinder for rotating said guide tube and thus shifting the engagement strip radially within the groove.

5. Cylinder according to claim 1, further including a tensioning spindle (7) having a groove therein to receive at least one end portion of a rubber blanket (2).

6. Cylinder according to claim 1, further including a clamping spindle (7) having a groove therein dimensioned to receive both end portions (4, 5) of a rubber blanket (2).

7. Cylinder according to claim 1, further including a clamping spindle (18) having a groove formed therein to receive one end strip (4) of a rubber blanket (3);

a holding groove (17) positioned within the axially extending groove and dimensioned to receive the other end portion of the rubber blanket;

and a circumferentially acting removal means (20) located on the clamping spindle (18) and engageable with the other end portion of the blanket to remove the other end portion from the holding groove.

8. Cylinder according to claim 7, wherein the circumferentially acting removal means (20) comprises a magnetically acting system.

9. Cylinder according to claim 7, further including a clamping spindle (7, 18, 26) formed with a recess on its circumference and receiving an end portion of the cover;

and wherein the clamping spindle is of essentially circular cross section, and formed with a flat outer surface (19) to provide a relief surface to facilitate insertion of the end portions of the cover into the groove.

10. Cylinder according to claim 1, wherein one part of the interengaging lifting means (10, 11) comprises a guide tube (11) formed with an axially extending slot, and rotatably positioned within a part-circular opening in the groove;

the other part comprises an engagement strip (10) formed on the filler strip (8) and engaging within the slot of the guide tube;

and a geared drive coupled to an end portion of the guide tube, located adjacent an end face of the cylinder for rotating said guide tube and thus shifting the engagement strip radially within the groove.

11. Cylinder according to claim 1, further including a clamping spindle (7, 18, 26) formed with a recess on its circumference and receiving an end portion of the cover;

and wherein the clamping spindle is of essentially circular cross section, and formed with a flat outer surface (19) to provide a relief surface to facilitate insertion of the end portions of the cover into the groove.

12. Cylinder according to claim 1, wherein the cover comprises a rubber blanket including a backing and a rubber covering (31), the rubber covering being shorter than the longitudinal extent of the backing;

and wherein the end edges of the rubber covering are located on the blanket dimensioned to fit exactly around the circumference of the cylinder when stretched about the circumference thereof with the edges (36, 37) of the rubber covering fitting against each other to provide an essentially continuous blanket covering about the cylinder.

13. Cylinder according to claim 12, wherein the end portions (36, 37) extend at a slight angle of inclination with respect to the axis of rotation of the cylinder.

14. The combination of a printing cylinder as claimed in claim 1 with a rubber blanket wherein the rubber blanket comprises a backing and a rubber covering, the rubber covering being shorter than the longitudinal extent of the backing;

and wherein the end edges (36, 37) of the rubber covering are located on the blanket to closely fit against each other when the blanket is placed about the circumference of the cylinder with the filler strip (8) in supported position to provide an essentially continuous blanket covering about the circumference of the cylinder.

15. Combination according to claim 14, wherein the end portions (36, 37) extend at a slight angle of inclination with respect to the axis of rotation of the cylinder.

* * * * *